United States Patent [19]

Manecke

[11] Patent Number: 4,514,180

[45] Date of Patent: Apr. 30, 1985

[54] METHOD OF MAKING FILTER FOR A CIGARETTE PRODUCT

[75] Inventor: Kurt A. Manecke, Valley Station, Ky.

[73] Assignee: Brown & Williamson Tobacco Corporation, Louisville, Ky.

[21] Appl. No.: 395,428

[22] Filed: Jul. 6, 1982

Related U.S. Application Data

[62] Division of Ser. No. 254,804, Apr. 16, 1981.

[51] Int. Cl.[3] ..... A24C 5/50

[52] U.S. Cl. ..... 493/41; 493/49; 493/50

[58] Field of Search ..... 493/50, 49, 47, 46, 493/45, 39, 41; 118/411; 156/201, 203; 53/214

[56] References Cited

U.S. PATENT DOCUMENTS

| | | | |
|---|---|---|---|
| 2,202,839 | 6/1940 | Davidson | 493/50 X |
| 2,261,344 | 11/1941 | Delegard | 53/214 X |
| 3,298,353 | 1/1967 | Huffman | 118/411 |
| 3,494,095 | 2/1970 | Valvano | 53/214 X |
| 3,828,658 | 8/1974 | Brodbeck et al. | 493/48 X |
| 4,036,114 | 7/1977 | Luke | 493/39 |

*Primary Examiner*—James F. Coan

*Attorney, Agent, or Firm*—Charles G. Lamb

[57] ABSTRACT

A filter for a cigarette product has a cylindrical filter plug or element surrounded by a filter wrapping material. The overlapping edges of the filter wrap are secured together by a line of adhesive along and between the overlapping edges. The filter wrap is anchored to the filter plug by another line of adhesive between the filter wrap and filter plug superimposed with the line of adhesive securing the overlapping edges of the filter wrap.

2 Claims, 3 Drawing Figures

METHOD OF MAKING FILTER FOR A CIGARETTE PRODUCT

This is a division of application Ser. No. 254,804, filed Apr. 16, 1981.

BACKGROUND OF THE INVENTION (A) Field of the Invention

The present invention relates to cigarette products, and more particularly to a filter for a cigarette product and a method for making the filter.

(B) Description of the Prior Art

When filter cigarettes were first introduced, it was a common and acceptable practice to wrap the filter tow or plug with a non-porous wrapper. The wrapper was held in place or attached to the filter plug by a line of adhesive. However, with the advent of a porous filter plug wrap, it was found that the adhesive anchoring of the porous plug wrap to the filter plug would penetrate the porous wrap causing an adhesive build-up in critical areas of the filter rod making machines. This resulted in a substantial amount of down-time to periodically clean the filter rod making machines. In addition, as adhesive build-up occurred, the quality of the manufacture of filter rods was adversely affected. To solve this problem, the line of adhesive for anchoring the porous filter wrap to the filter plug was eliminated. However, due to the elimination of the anchoring line of adhesive, it has become common to experience filter cigarettes wherein the filter plug has moved relative to the filter wrap and is recessed into the filter wrap.

In recent years, it has been suggested that a film forming substance be first applied to the filter wrap at a location or locations therealong coinciding with a region or regions at which adhesives are to be applied to create an impervious barrier to the adhesive. Two patents which relate to the present problem are U.S. Pat. No. 4,036,114 and U.S. Pat. No. 3,298,353.

SUMMARY OF THE INVENTION

The present invention provides a filter for a cigarette product, and a method of making same, having a filter plug adhesively anchored to a surrounding porous filter plug wrap which does not cause undue adhesive build-up in the critical areas of the filter rod making machines and does not alter the ventilation parameters of the porous filter wrap.

The invention provides a filter for a cigarette product having a cylindrical filter plug circumferentially wrapped with a porous filter wrap wherein the overlapping edges of the filter wrap are secured together by a line of adhesive and the filter wrap is anchored to the filter plug by another line of adhesive superimposed to the line of adhesive securing the overlapping edges of the filter wrap.

BRIEF DESCRIPTION OF THE DRAWINGS

The present invention will be more clearly understood upon reference to the following detailed description and drawings wherein like numerals refer to like parts throughout the views, and wherein.

DESCRIPTION OF THE PREFERRED EMBODIMENT

Figure 1:
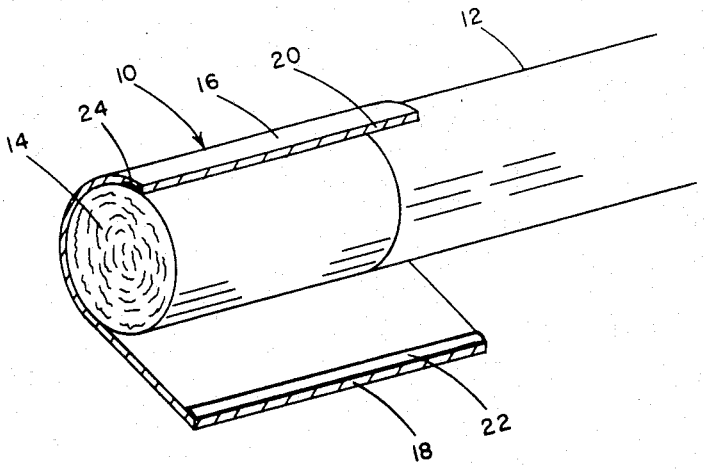
FIG. 1 is a perspective view of a cigarette product having a filter incoporating features of the present invention, the filter wrap for the filter plug being shown in unwrapped condition.
Figure 2:
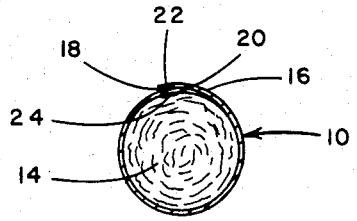
FIG. 2 is an end view of the cigarette product of FIG. 1.

FIGS. 1 and 2 illustrate a cigarette product, generally denoted as the numeral 10, comprised of a paper wrapped tobacco column 12, a cylindrical filter plug 14 in coaxial relationship with the tobacco column, and a porous filter wrap 16 surrounding the filter plug. (Filter wrap 16 is shown in unwrapped condition to best show the location of adhesive lines to be discussed hereinafter.) As can be best seen in FIG. 2, the edges 18 and 20 of the filter wrap 16 surrounding the filter plug 14 are overlapped with one another forming the seam of the filter wrap. A first line of adhesive 22 is disposed along and between the overlapped edges 18 and 20 of the filter wrap and secures the overlapped edges 18 and 20 together. A second line of adhesive 24 is disposed between the filter wrap 16 and the filter plug 14 to anchor the filter wrap 16 to the filter plug 14. The second line of adhesive prevents the filter wrap 16 and filter plug 14 from shifting longitudinally relative to each other which could otherwise result in, for example, a recessed filter plug 14. The second line of adhesive 24 is in superimposed relationship with the first line of adhesive beneath the seam of the filter wrap 16 defined by the overlapped edges 18 and 20 of the filter wrap 16.

Figure 3:
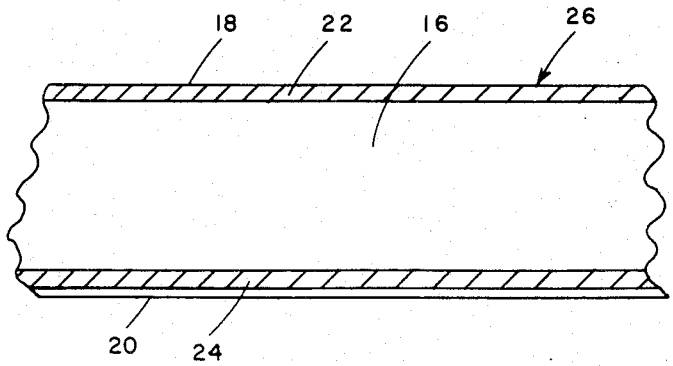
FIG. 3 is a plan view of a web of porous filter wrap incorporating features of the present invention.

Now with reference to FIG. 3; during the process of manufacturing the cigarette product 10, the first and second lines of adhesive 22 and 24, respectively, are applied to a web 26 of porous filter wrap 16 generally along the opposite parallel longitudinal edges 18 and 20 of the web 26 of filter wrap 16. The width of the web 26 of filter wrap 16 is slightly greater than the circumference of the cylindrical filter plug 14 so the longitudinal edges of the web 26 will be the overlapping edges of the filter wrap 16. Both the first and second lines of adhesive 22 and 24, respectively, are applied to the same surface of the web 26 of filter wrap 16. However, adhesive line 24 does not extend, widthwise, to the edge 20 so that in use, as best shown in FIG. 2, adhesives 22 and 24 are in alignment. Next, a cylindrical filter plug is added to the surface of the web 26 of filter wrap 16 having the first and second lines of adhesive. The filter plug and web are disposed in mutual longitudinal relationship. After the filter plug is added to the web of filter wrap, the web of filter wrap is formed around the circumference of the filter plug and the longitudinal edges 18 and 20 of the web 26 are overlapped so that one of the lines of adhesive, for example, the first line of adhesive 22 is disposed between the overlapping edges 18 and 20 of the web 26 of filter wrap securing the overlapping edges 18 and 20 together, and the other line of adhesive, for example, the second line of adhesive is disposed between the filter wrap and the filter plug in superimposed relationship to the first line of adhesive 22 thereby anchoring the filter wrap to the filter plug.

It has been found in practice that good results can be obtained by using a hot melt adhesive.

The foregoing detailed description is given primarily for clearness of understanding and no unnecessary limitations are to be understood therefrom for modifications will become obvious to one skilled in the art upon reading this disclosure and may be made without departing from the spirit of the invention and scope of the appended claims.

What is claimed is:

1. A method of making a cylindrical filter for a cigarette product comprising the steps of:

applying spaced parallel lines of a hot melt adhesive along opposite longitudinal portions of and to the same surface of a web of porous filter wrap material having a width slightly greater than the circumference of the cylindrical filter the distance between said spaced parallel lines of adhesive being substantially equal to the circumference of said filter rod;

adding a cylindrical filter plug to the web of filter wrap material so that the surface of the web having said adhesive lines is contiguous to the cylindrical filter plug; and, forming the web of filter wrap around the filter plug and overlapping the longitudinal edges of the web whereby one of said lines of adhesive is disposed between the overlapping longitudinal edges of the web of filter wrap securing the overlapping longitudinal edges of the web of filter wrap together and the other line of adhesive is disposed between the web of filter wrap and the filter plug superimposed with the first line of adhesive thereby anchoring the filter wrap to the filter plug.

2. The method of claim 1 wherein one of the parallel lines of adhesive is applied substantially along one of the longitudinal edges of said filter wrap.

* * * * *